United States Patent [19]

Gostling

[11] 4,015,395

[45] Apr. 5, 1977

[54] PUNCHEON UNIT FOR BUILDERS SCAFFOLDING

[75] Inventor: Peter Eric Gostling, Sutton Coldfield, England

[73] Assignee: C. Evans & Sons Limited, Ilford, United Kingdom

[22] Filed: June 9, 1975

[21] Appl. No.: 585,065

[30] Foreign Application Priority Data

June 13, 1974 United Kingdom ..... 26276/74

[52] U.S. Cl. ..... 52/637; 182/178; 182/179

[51] Int. Cl.[2] ..... E04G 1/14; E04H 12/00

[58] Field of Search ..... 182/178, 179; 52/638, 52/637

[56] References Cited

UNITED STATES PATENTS

| | | | |
|---|---|---|---|
| 1,552,333 | 9/1925 | Mosher | 52/638 |
| 3,604,175 | 9/1971 | Gray | 182/178 |
| 3,613,832 | 10/1971 | Dunster | 182/179 |
| 3,650,078 | 3/1972 | Jenning | 182/179 |
| 3,835,612 | 9/1974 | Beziat | 182/178 |

FOREIGN PATENTS OR APPLICATIONS

| | | | |
|---|---|---|---|
| 1,279,661 | 11/1961 | France | 182/178 |
| 54,240 | 10/1967 | Poland | 182/178 |
| 1,090,185 | 11/1967 | United Kingdom | 182/178 |

*Primary Examiner*—Reinaldo P. Machado
*Attorney, Agent, or Firm*—Melville, Strasser, Foster & Hoffman

[57] ABSTRACT

For use in a scaffold structure having upright support members provided with spaced support elements and cross members for attachment to said support elements of said upright members, a puncheon unit comprising an outer member for attachment to one of said upright members and an inner member telescopically received in said outer member, said outer member having support elements for said cross members and said inner member having support elements for said cross members and transverse holes co-acting with locking means to lock said inner member relative to said outer member. A slidably mounted support collar having support elements for said cross members is provided on said inner member.

8 Claims, 6 Drawing Figures

Figure 1:
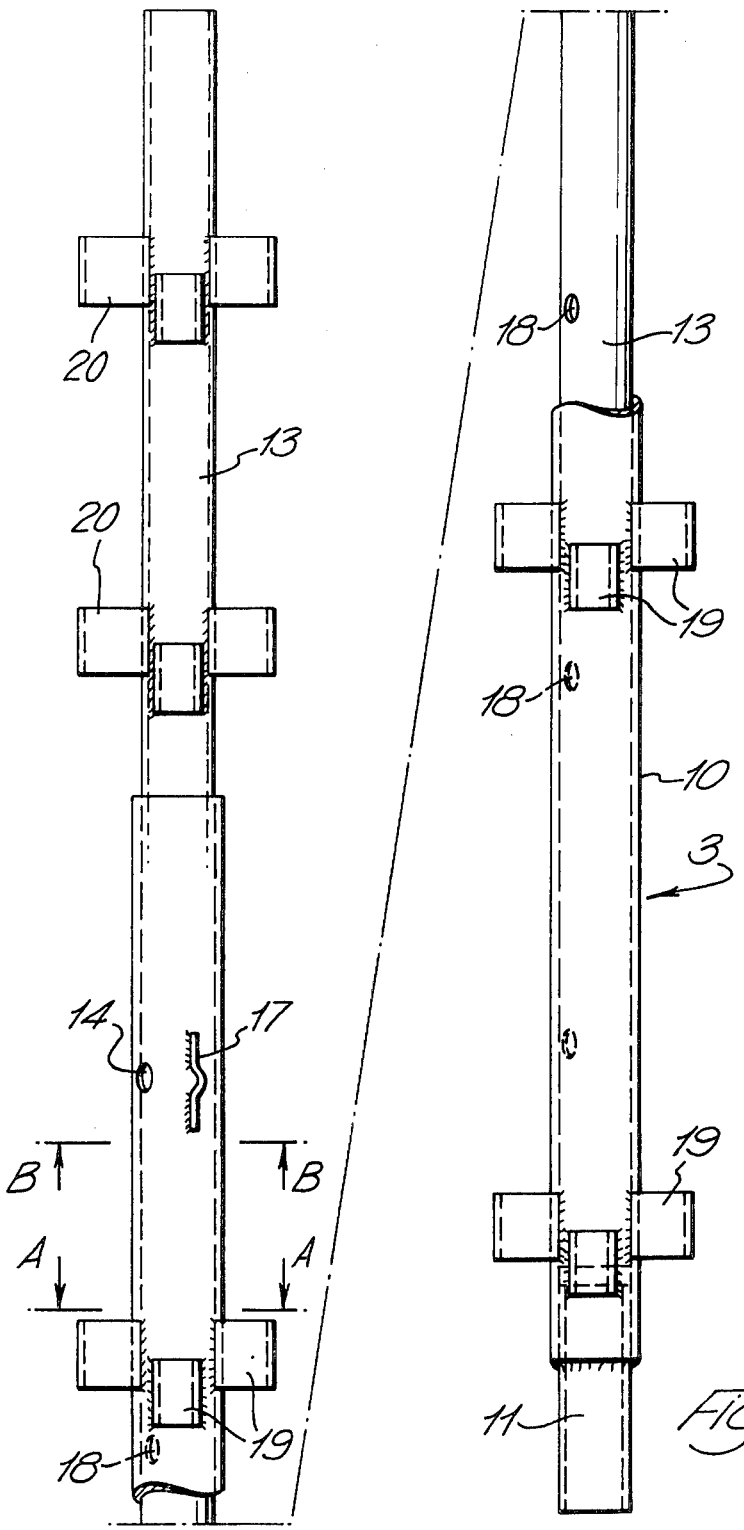

4
20
1
4
18
13
5
20
21
13
14
15
5
19
3
18
19
15
14
10
5
3
10
12
2
9
9

PUNCHEON UNIT FOR BUILDERS SCAFFOLDING

This invention relates to a puncheon unit for use with builders scaffolding with particular reference to scaffolding of the kind disclosed in our U.S. Pat. Nos. 3,879,143 and 3,880,533 when used for propping purposes.

The aforementioned scaffolding is of the kind comprising upright supports or standards and cross members which are interconnected to form a rigid structure. In the present context, the term "cross members" includes horizontally extending ledgers, horizontally extending transoms, and diagonal and other bracing members. In order to support the cross members, the upright supports or standards in the aforementioned scaffolding are provided with longitudinally spaced channel-shaped support elements, the spacing between support elements being uniform and is hereinafter referred to as "the standard spacing."

Furthermore, in the aforementioned scaffolding, where it is required to support, for example, floor or like shuttering which may be inclined to the horizontal, it is the practice to use puncheon units which are attached to the uppermost ends of the upright supports or standards, the puncheon units providing means for spanning "non-standard" distances between the "standard length" upright supports and the shuttering support means. A puncheon unit comprises an outer tubular member and an inner tubular member telescopically received therein, the outer member being formed with a transverse hole to co-act with one of a plurality of transverse holes in the inner member, whereby lengthwise adjustment is obtained by passing a locking pin through selected co-acting holes.

It is among the objects of the present invention to provide an improved puncheon unit which increases the adjustability feature and, when in use, provides a more rigid propping structure.

According to the present invention, there is provided a puncheon unit for use with a scaffold structure of the kind hereinbefore described, which comprises an outer tubular member having a transverse hole to receive a locking pin, an inner tubular member telescopically received in the outer member and being formed with a plurality of spaced transverse holes to co-act with the holes of the outer member, wherein both the outer and the inner members are additionally formed with spaced cross-member channel-shaped support elements, the spacing of the holes and the support elements of the inner member being not more than the standard spacing but being a multiple of the latter.

According to a further aspect of the invention, the inner member of the puncheon unit is provided with a slidable collar formed with cross-member channel-shaped support elements and with a transverse hole to co-act with the transverse holes of the inner member, whereby the collar can be fixed to the inner member at a selected position along the length thereof.

In accordance with the invention furthermore, the holes in the outer member, the inner member and the collar are disposed at an angle which is inclined to the planes in which the cross-member channel-shaped support elements are disposed.

Figure 2:
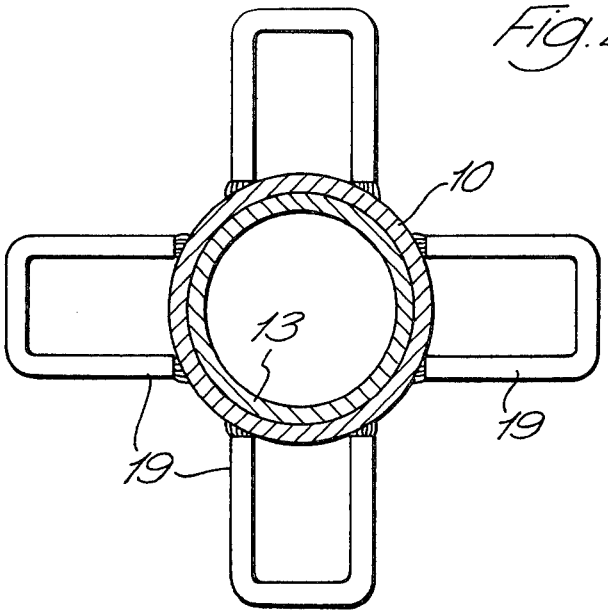
Figure 3:
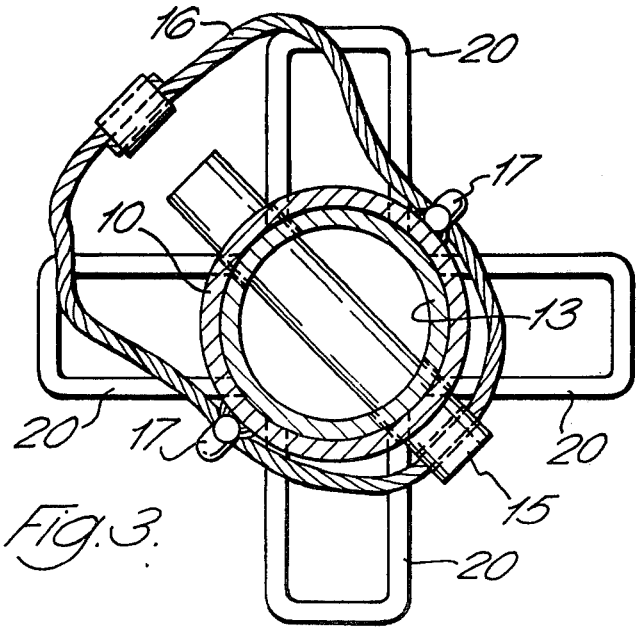
Figure 4:
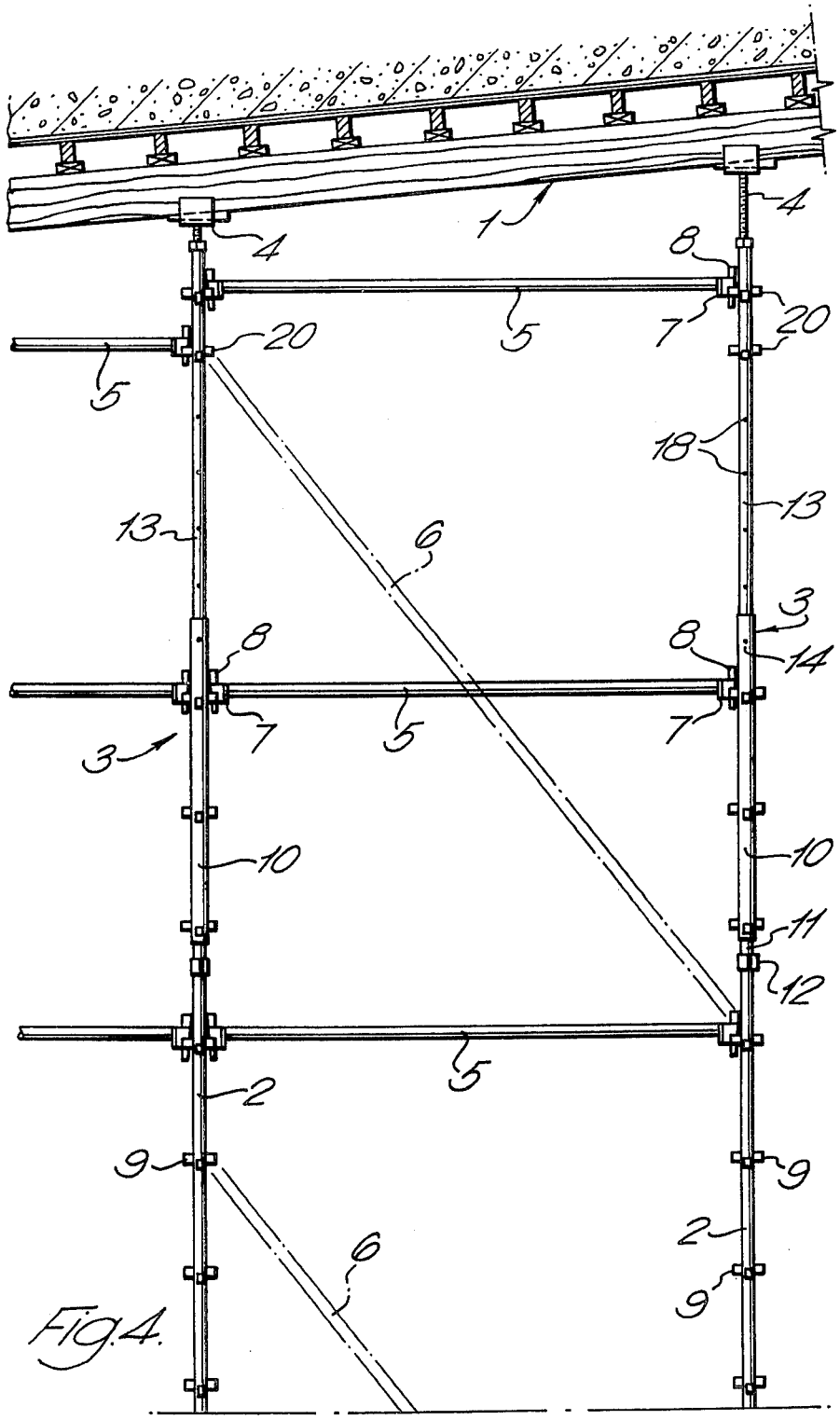
Figure 5:
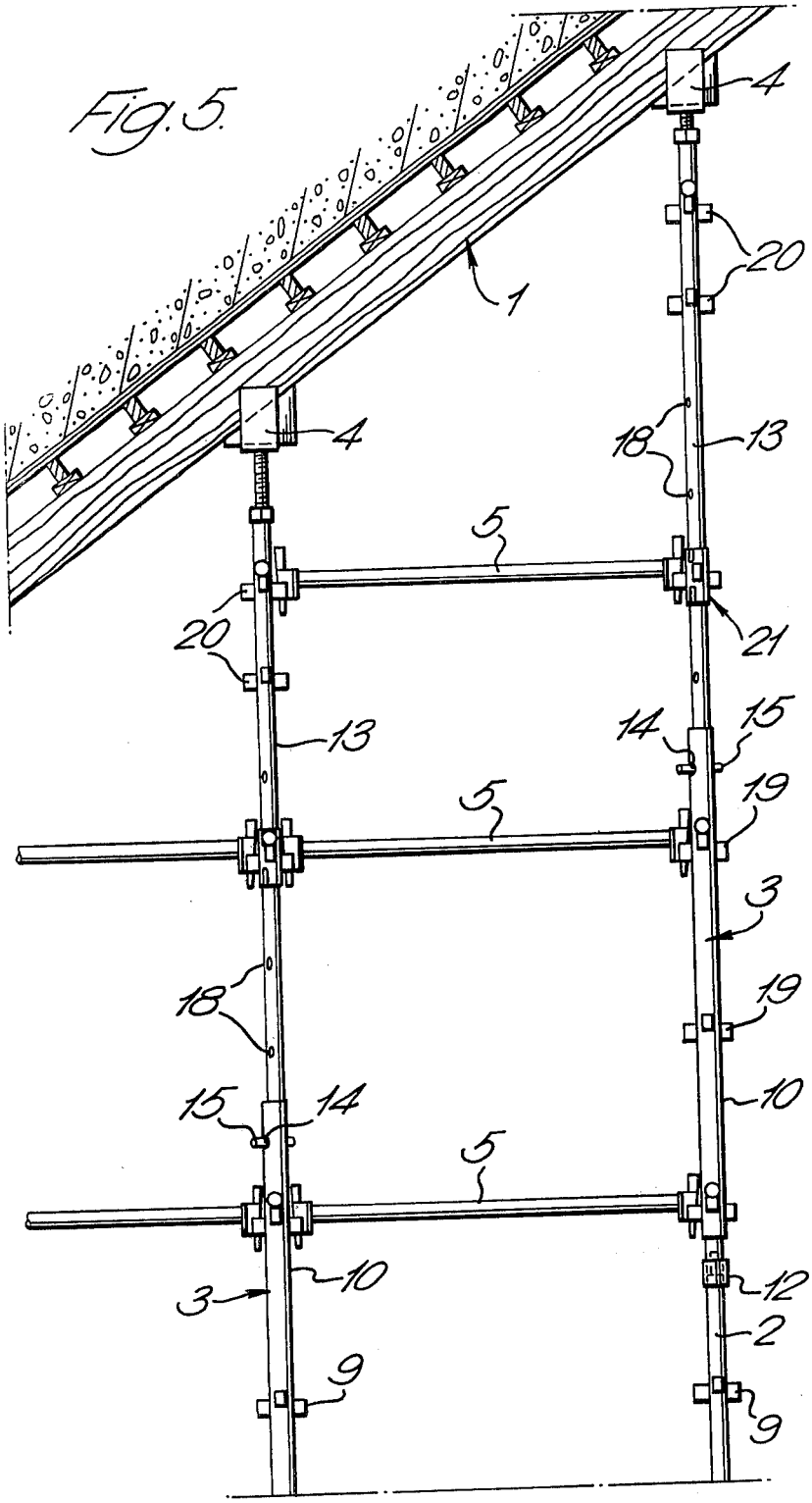
Figure 6:
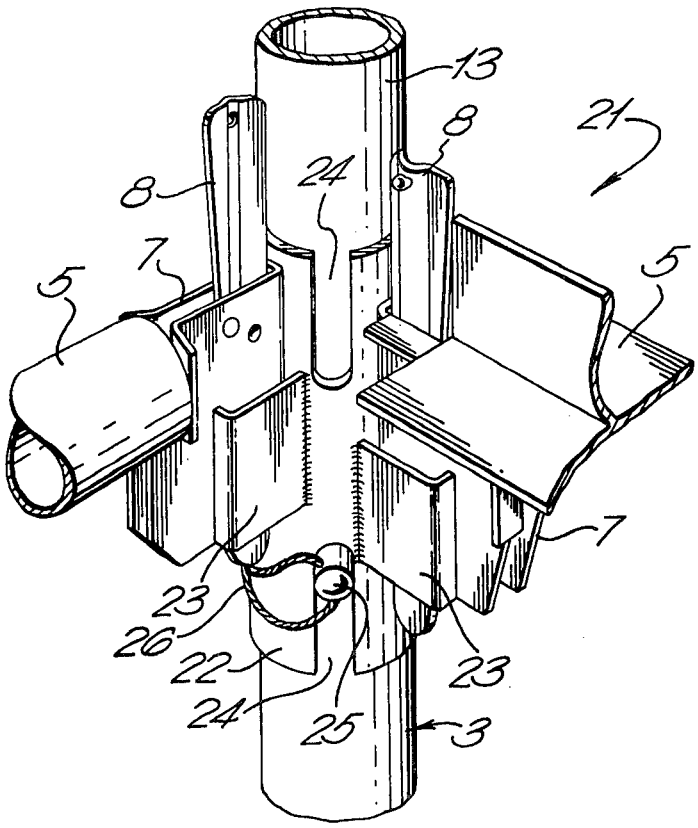

The invention is illustrated by way of example in the accompanying drawings in which, FIG. 1 is an elevation of the outer member of a puncheon unit according to the invention, FIG. 2 is a section, on an enlarged scale, on the line A—A of FIG. 1, FIG. 3 is a section, on an enlarged scale, on the line B—B of FIG. 1 and additionally showing a locking pin and retainer loop therefore in the position of use, FIG. 4 is a general view of an upper part of a scaffold structure incorporating puncheon units according to the invention, FIG. 5 shows an upper part of a scaffold structure with puncheon units of the invention additionally including adjustable collars, and FIG. 6 is an enlarged perspective view showing an adjustable collar in position on a puncheon inner member.

Referring first to FIG. 4 of the drawings, there is shown part of a scaffold structure for use in supporting inclined shuttering generally shown at 1 for the purpose of constructing a concrete floor or the like.

The scaffold structure comprises, generally, adjustable base jacks (not shown) supporting standard length upright supports or standards 2, puncheon units 3 and adjustable fork head elements 4 all of which are adapted to interengage with one another. These upright members are interconnected by horizontal ledgers 5 and horizontal transoms (not shown) which lie at right angles to the ledgers 5. In addition, suitable diagonal brace members 6 are provided.

In order to support the ledgers 5 and the transoms both of which are formed with hook-shaped ends 7 and co-acting wedges 8, the uprights or standards 2 are provided with two pairs of diametrically opposite channel-shaped support elements 9, the hooks 7 and the support elements 9 being in accordance with the disclosure in U.S. Pat. Nos. 3,879,143 and 3,880,533. The support elements 9 on the uprights or standards 2 are uniformly spaced apart to provide what is termed as the standard spacing.

Referring additionally to FIGS. 1 to 3 of the drawings, each puncheon unit 3 comprises an outer tubular member 10 having, at one end, a spigot 11 by which it is attached, by means of a suitable fitting 12, to the upper end of an upright or standard 2, its other end being adapted to receive, telescopically, an inner tubular member 13. Adjacent said other end the outer member 10 is formed with a transverse diametrically disposed hole 14 to receive a locking pin 15 as is shown in FIG. 3. The pin 15 is retained in the vicinity of the hole 14 by being attached to a cable retainer loop 16 held in position by means of support eyes 17 welded to the outer member 10.

The inner member 13 is provided with a plurality of spaced transverse diametrically disposed holes 18 which correspond in size and position to the hole 14. In practice, in order to adjust the length of the puncheon unit 3, the inner member 13 is moved relative to the outer member 10 to bring one of the holes 18 into alignment with the hole 14 and the locking pin 15 is passed through the coincident holes to lock the inner and outer members relative to one another.

In order to provide rigidity to the structure in the vicinity of the puncheon units 3, the outer member 10 of each unit is provided with channel-shaped support elements 19 corresponding to the elements 9 of the uprights 2, the elements 19 also being arranged at the standard spacing, and being positioned to receive the ends 7 of ledgers 5 and transoms.

Further rigidity is provided by positioning channel-shaped support elements 20 corresponding to the elements 9 of the uprights 2 on the outermost ends of the inner members 13 of the puncheon units 3. The elements 20 also being adapted to receive the ends of ledgers and transoms for bracing purposes. In this respect, in order to maintain and use standard length ledgers and transoms, the support elements 9 and 20 are each provided to project the same distance from the longitudinal axis of the puncheon unit.

As can be seen from the drawings, the elements 20 are spaced in continuation of the series of holes 18 and it is an important feature of the invention that, in order to provide maximum adjustment, the spacing of the holes 18 and the elements 20 is a multiple of the standard spacing of the elements 9 of the uprights 2. Thus, the spacing is preferably one half the standard spacing although it may be one quarter of the standard spacing. Alternatively, in certain circumstances, the spacing may correspond to that of the standard spacing.

As can be seen from FIG. 4 of the drawings, the aforementioned arrangement provides a rigid structure over the whole length of the puncheon units 3. However, where the angle of the shuttering is greater as is shown in FIG. 5 of the drawings where corresponding reference numerals are used, it is necessary to provide intermediate support means. Thus, as can be seen in FIG. 5, due to the angle of the shuttering 1, the inner member 13 of the puncheon unit 3 would not normally be braced in any way because the elements 20 of the two units 3 are out of horizontal alignment. In order to overcome this problem, as is shown in FIG. 5, there is provided a collar 21 which is slidably mounted on the inner member 13 of the puncheon unit 3. The collar 21 comprises a sleeve 22 having channel-shaped support elements 23 corresponding to the elements 9 of the uprights 2. The sleeve 22 is formed at each end thereof with a pair of diametrically disposed slots 24 which co-act with a locking pin 25 held captive by means of a retainer loop 26. Thus, using the holes 18, the collar 21 can be positioned on the inner member 13 to provide a support at the desired position. The provision of the slots 24 at each end of the sleeve 22 enables the collar to be used either way up and therefore avoids the possibility of the collar being positioned wrongly on the member 13.

A further feature of the invention is that, in order to avoid interference by the pins 15 to 25 with the ledgers and transoms, the holes 14 and 18, and the slots 24, are disposed at an angle to the planes of the elements 9, 19, 20 and 23, such angle preferably being 45°.

Thus, it will be seen that the puncheon unit of the present invention provides an increased extent of adjustability over comparable known units.

Although the invention has been described with reference to the propping of shuttering for floors and the like, it will of course be understood that it is not limited in this respect and can be used for other purposes such as the propping of retaining walls and the like where the upright members of the structure are disposed horizontally.

I claim:

1. A puncheon unit for use with a scaffold structure of the kind comprising upright support members having support elements arranged at a standard spacing, and cross members attached at their ends to said support elements, said puncheon unit comprising an outer tubular member formed at one end to be attached to an upright support member of said scaffold structure and, at or near its other end, with a transverse hole to receive a locking pin, an inner tubular member telescopically received in said outer member and formed with a series of spaced transverse holes to coact with said hole of said outer member, wherein both said outer member and said inner member are additionally provided with spaced cross member channel-shaped support elements, the spacing of said support elements of said outer member corresponding to said standard spacing of said support elements of said upright support members, and the spacing of said transverse holes and said support elements of said inner member being from a fraction up to 1 times said spacing, said spaced cross member channel-shaped support elements each projecting the same distance from the longitudinal axis of said inner and outer tubular members.

2. A puncheon unit as claimed in claim 1, in which said spacing of said transverse holes and said support elements of said inner member is one half of said spacing of said support elements of said outer member.

3. A puncheon unit as claimed in claim 1, in which said spacing of said transverse holes and said support elements of said inner member is one quarter of said spacing of said support elements of said outer member.

4. A puncheon unit as claimed in claim 1, in which said transverse holes in said inner member and said outer member are disposed at an angle to the planes of said support elements.

5. A puncheon unit as claimed in claim 4, in which said angle is 45°.

6. A puncheon unit as claimed in claim 1 including a support collar for attachment of said cross members, said support collar being slidably mounted on said inner member, said support collar comprising a sleeve having channel-shaped support elements affixed thereto for the receipt of the ends of said cross members, said channel-shaped support elements on said sleeve projecting the same distance from the longitudinal axis of said inner and outer tubular members as said channel-shaped support elements on said inner and outer tubular members, and means for releasably attaching said sleeve relative to one of said transverse holes in said inner member.

7. A puncheon unit as claimed in claim 6, in which said attaching means for said sleeve comprise axially disposed slots formed in at least one end of said sleeve and a locking pin arranged to pass through said slots and a selected one of said transverse holes in said inner member.

8. The structure claimed in claim 1 including an adjustable fork head element mounted on the free end of said inner member.

* * * * *